US008118716B2

(12) United States Patent
Grossman

(10) Patent No.: US 8,118,716 B2
(45) Date of Patent: Feb. 21, 2012

(54) POGO STICK

(75) Inventor: Martin Grossman, Glasgow (GB)

(73) Assignee: H. Grossman Limited, Glasgow (GB)

( * ) Notice: Subject to any disclaimer, the term of this patent is extended or adjusted under 35 U.S.C. 154(b) by 0 days.

(21) Appl. No.: 11/562,936

(22) Filed: Nov. 22, 2006

(65) Prior Publication Data

US 2007/0270289 A1 Nov. 22, 2007

(30) Foreign Application Priority Data

Nov. 22, 2005 (GB) ..... 0523769.8

(51) Int. Cl.
*A63B 26/00* (2006.01)

(52) U.S. Cl. ..... 482/77

(58) Field of Classification Search ..... 482/77–78, 482/111–113, 5–9; D21/413
See application file for complete search history.

(56) References Cited

U.S. PATENT DOCUMENTS

| | | | | |
|---|---|---|---|---|
| 2,871,016 | A | 1/1959 | Rapaport | 272/57 |
| 3,731,920 | A | 5/1973 | Matsuda | 272/57 E |
| 3,958,803 | A | 5/1976 | Geisselbrecht | 272/135 |
| 3,968,359 | A | 7/1976 | Shaffer | 240/51.11 R |
| D263,485 | S | 3/1982 | Rudell et al. | D21/67 |
| D316,280 | S | 4/1991 | White | D21/67 |
| 5,037,088 | A | 8/1991 | Bernstein | 272/132 |
| 5,586,957 | A | 12/1996 | Wilkinson | 482/74 |
| 5,913,752 | A * | 6/1999 | Bolf | 482/72 |
| 6,168,555 | B1 * | 1/2001 | Fetterleigh et al. | 482/77 |
| D462,400 | S | 9/2002 | Kim | D21/413 |
| 6,589,140 | B1 | 7/2003 | Hsu | 482/77 |
| D479,733 | S * | 9/2003 | Arginsky | D21/413 |
| 6,634,767 | B2 | 10/2003 | Huang | 362/252 |
| D487,484 | S * | 3/2004 | Arginsky | D21/413 |
| 6,827,673 | B2 | 12/2004 | Chen et al. | 482/77 |
| 6,908,206 | B1 | 6/2005 | Pinciaro | 362/34 |
| 6,932,746 | B2 | 8/2005 | Wong | 482/77 |
| D562,913 | S | 2/2008 | Grossman | D21/413 |
| 7,381,165 | B2 | 6/2008 | Arginsky et al. | 482/77 |
| 2002/0154503 | A1 | 10/2002 | Pan | 362/227 |
| 2003/0012019 | A1 | 1/2003 | Pan | 362/231 |

(Continued)

FOREIGN PATENT DOCUMENTS

DE 83 18 655.7 U1 11/1983

(Continued)

OTHER PUBLICATIONS

Pogo stick shown on webpage: http://web.archive.org/web/20040628065138/http://www.growingtreetoys.com/images/products/bg/009791.jpg.

(Continued)

*Primary Examiner* — Fenn Mathew
(74) *Attorney, Agent, or Firm* — Tarolli, Sundheim, Covell & Tummino LLP

(57) ABSTRACT

A pogo stick or like device is provided and includes at least one illuminatable or illumination means. The pogo stick may have a frame including a tubular member. The tubular member may extend substantially longitudinally, may be located substantially co-axially with a central axis of the pogo stick, and may include a structural member. The pogo stick may have a pair of handles extending from the frame and may have platform means. The illuminatable or illumination means may include at least one vertically extending member, and beneficially a pair of illumination means, each including a vertically extending member located on either side of the tubular member.

7 Claims, 18 Drawing Sheets

U.S. PATENT DOCUMENTS

| | | | | |
|---|---|---|---|---|
| 2003/0027689 | A1 | 2/2003 | Chien | 482/23 |
| 2003/0045405 | A1 * | 3/2003 | Lin | 482/77 |
| 2003/0096678 | A1 * | 5/2003 | Wong | 482/77 |
| 2004/0214691 | A1 | 10/2004 | Gottlieb-Myers et al. | 482/15 |
| 2005/0018435 | A1 | 1/2005 | Selkee et al. | 362/427 |
| 2005/0185396 | A1 | 8/2005 | Kutler | 362/218 |
| 2007/0042874 | A1 * | 2/2007 | Arginsky et al. | 482/77 |
| 2007/0042875 | A1 * | 2/2007 | Arginsky et al. | 482/77 |

FOREIGN PATENT DOCUMENTS

| | | | |
|---|---|---|---|
| DE | 87 01 120.4 | U1 | 4/1987 |
| EP | 000553797-0001 | | 8/2006 |
| EP | 000553797-0002 | | 8/2006 |
| FR | 2 671 286 | A1 | 7/1992 |
| JP | 2003-135625 | | 5/2003 |

OTHER PUBLICATIONS

Pogo stick shown on webpage: http://web.archive.org/web/20030724225006/http://cs-intl.com/POGO_Stick.JPG.
Pogo sticks shown on webpage: http://web.archive.org/web/20030811145640/http://www.rostonefitness.com/pogo.jpg.
U.S. Games.com Summer 2002 Catalog, p. 13.
The Grandparents Toy Connection TM 2002/2003 Catalog, p. 27.
Cabela's Master Catalog, Fall 2001, Edition 1, item f (pogo sticks), unnumbered page.
Bits and Pieces Fall 2002 catalog, p. 40.
European Search Report for European patent application No. EP 06 25 5918.
Search Report for United Kingdom patent application No. GB 05 23 769.8.

* cited by examiner

POGO STICK

CROSS-REFERENCE TO RELATED APPLICATION

This application claims priority to United Kingdom patent application no. 05 23 769.8 filed Nov. 22, 2005, and the entire contents of this application are expressly incorporated herein by reference thereto.

FIELD OF INVENTION

The present invention relates to amusement devices or toys, and more particularly, though not exclusively, to devices generally known as "pogo sticks".

BACKGROUND TO INVENTION

Pogo sticks have been known for some time. An example is that disclosed in U.S. Pat. No. 2,793,036 (HANSBURG).

At least one aspect of the present invention seeks to obviate or mitigate one or more problems and/or disadvantages of known pogo sticks.

At least one aspect of the present invention provides an improved pogo stick with a novel or novelty lighting effect.

It is a further object of at least one embodiment of at least one aspect of the present invention to provide an alternative to known pogo sticks.

SUMMARY OF INVENTION

The invention relates to providing one or more illumination means on a pogo stick or like amusement device.

According to a first aspect of the present invention there is provided a pogo stick or like device comprising at least one illuminatable or illumination means.

The pogo stick may comprise a frame comprising a tubular member.

The tubular member may extend substantially longitudinally, and may be located substantially co-axially with a central axis of the pogo stick, and may comprise a structural member.

The tubular member may comprise a first (upper) tubular portion and a second (lower) tubular portion.

The first and second tubular portions may be joined end to end.

An annular baffle or wall may be provided within the tubular member, e.g. at or near adjacent ends of the first and second tubular portions.

The pogo stick may comprise a pair of handles extending from the frame.

The pogo stick may comprise platform means.

Each handle may comprise a fixed end and a free end.

The free ends of each handle may substantially face one another.

The pogo stick may comprise biasing means.

The biasing means may bias a leg member to a first extended position relative to the tubular member.

An end of the leg member may be received within the tubular means from an end thereof.

Said end of the leg member may be received within the first tubular portion via the annular baffle.

Biasing means may be provided within the second tubular position, e.g. extending from the annular baffle to an annular member provided mid-way along the leg member.

The/each illuminatable or illumination means may comprise at least one vertically extending member.

The illuminatable or illumination means may comprise a pair of illumination means, and each may comprise a vertically extending member located on either side of the tubular member.

The/each vertically extending member may be made from a polymeric or plastics material, e.g. polyvinylchloride (PVC).

The/each illuminatable or illumination means may comprise a plurality of illumination devices, e.g. light emitting diodes (LEDs).

The plurality of illumination devices may comprise a plurality of sets of illumination devices.

The pogo stick may also comprise electronic circuitry, which may, in use, control illumination of the plurality of sets of illumination devices such that different sets are illuminated at different times.

Colours of illumination devices of different sets may be different from one another.

The illuminatable or illumination means may be powered by battery means.

The pogo stick may comprise switch means for switching the electronic circuitry and/or illuminatable means on or off.

The switch means may comprise an on-off switch, e.g. a rocker switch or push button switch. Alternatively or additionally, the switch means may comprise a vibration switch or motion sensor, which may activate when the pogo stick is in use.

According to a second aspect of the present invention there is provided a pogo stick or the like comprising a pair of handles, each handle comprising a fixed end and a free end, the free ends of each handle substantially facing one another.

The free end may be provided above the fixed ends.

According to a third aspect of the present invention there is provided a pogo stick or the like comprising at least one handle, where the handle is substantially U-shaped.

According to a fourth aspect of the present invention there is provided a pogo stick or the like comprising a single vertically extending frame or structural member.

The frame or structural member may comprise a tubular member.

An end of a leg of the pogo stick may be received within the frame member.

Optional features of the second to fourth aspects may be taken from those of the first aspect.

BRIEF DESCRIPTION OF DRAWINGS

Embodiments of the present invention will now be described, by way of example only, and with reference to the accompanying drawings, which are.

DETAILED DESCRIPTION OF DRAWINGS

Figure 1:
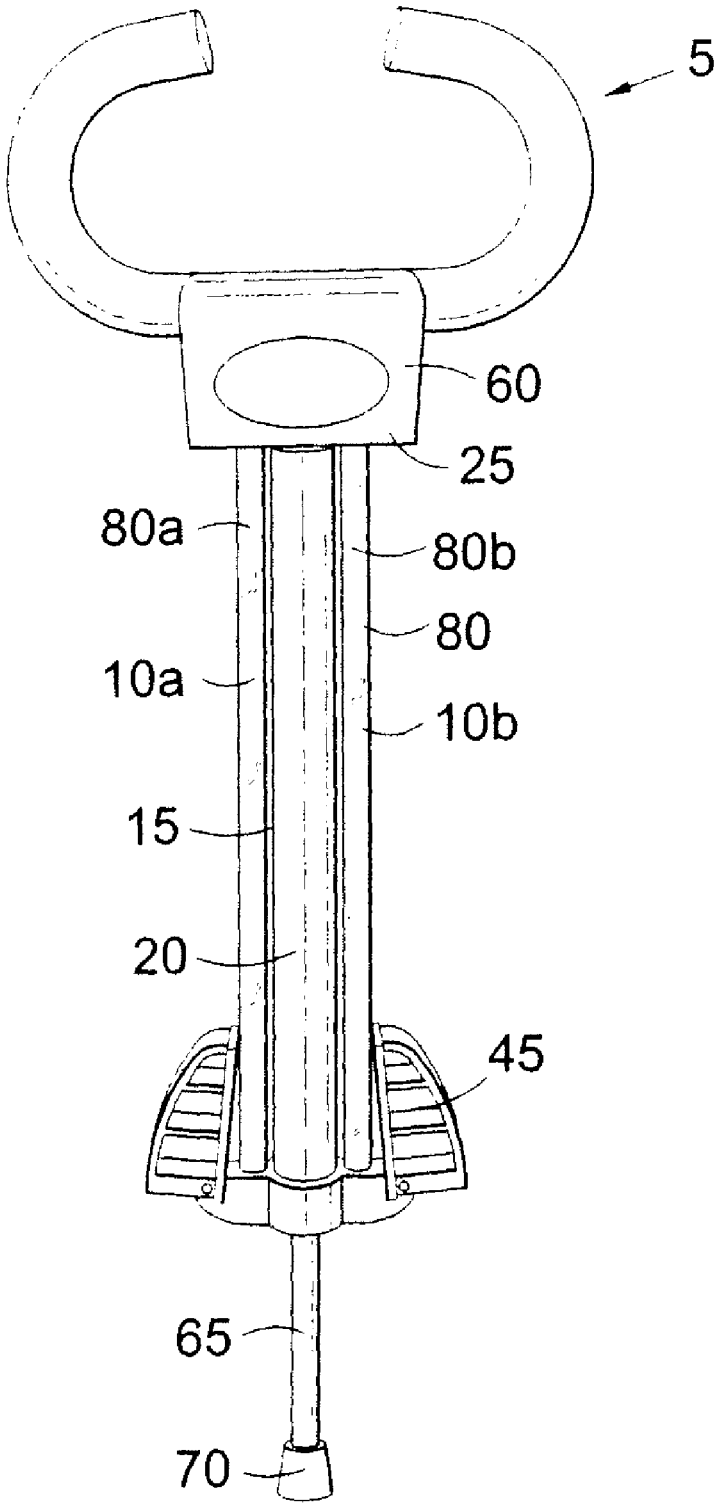
FIG. 1 a front view of a pogo stick according to a first embodiment of the present invention in a non-operational configuration.

Referring initially to FIGS. 1 to 10 there is shown a pogo stick, generally designated 5, according to a first embodiment of the present invention. The pogo stick 5 comprises illuminatable or illumination means 10*a*, 10*b* provided on either side of a central member 15. The central member 15 comprises a sheath 20 within which is provided a frame 25 comprising a tubular member 30 (not shown), Also provided within the sheath 20 and tubular member 30 is a biasing means 35 (not shown), which will be described hereinafter in greater detail.

The pogo stick 5 also comprises a leg 65. A lower end of the leg 65 comprises a ground engaging foot 70 which may be made of rubber or the like. An upper end of the leg 65 passes through a lower portion of the tubular member 30 and the biasing means 35 (which is in the form of a coiled spring), and is received within a lower end of an upper portion of the tubular member 30 through an annular wall or baffle (not shown). A lower end of the biasing means 35 is attached to the leg 65 via an annular lip member 75 (not shown), while an upper end of the biasing means 35 abuts the annular wall which is provided at or near a lower end of the upper portion of tubular member 30.

Each handle 40*a*, 40*b* comprises a fixed end and a free end, the free ends of each handle 40*a*, 40*b* in this embodiment substantially facing one another, as can best be seen from FIG. 1. In a non-operational mode (i.e. without a user standing on the platform means 45) the biasing means 35 bias the leg member 65 to a first extended position, as shown in FIGS. 1 to 5, relative to the frame 25.

Each illumination means 10*a*, 10*b* comprises at least one vertically extending tubular member 80. In this embodiment the illumination means 10*a*, 10*b* comprises a pair of vertically extending tubular members 80*a*, 80*b* located on either side of the frame 25 and sheath 20. Each vertically extending member 80*a*, 80*b* is in this example, made from a polymeric or plastics material, e.g. polyvinychloride (PVC), or any other suitably robust and/or shatterproof material.

Each illumination means 10*a*, 10*b* comprises a plurality of illumination devices, and in this implementation a plurality of light emitting diodes (LEDs) 85. The plurality of LED's comprise a plurality of sets of LEDs 85*a*, 85*b*, 85*c*, the illumination of which is, in use, controlled by control circuitry 90 provided within electronic enclosure 60. The circuitry 90 controls the illumination of the plurality of sets of LEDs 85*a*, 85*b*, 85*c* such that the LEDs are either nonilluminated, illuminated and/or different sets of LEDs are illuminated at different times, as can best be seen from FIGS. 2, 3, 4, and 5. The illumination effect can
also be seen from FIGS. 7, 8, 9, and 10. The LEDs 85 are in this embodiment powered by battery means 95 provided within the electronic enclosure 60.

Further, the pogo stick 5 comprises switch means 100 for switching the illuminatable or illumination means 10*a*, 10*b* on and/or off. The switch means 100 comprises in this embodiment, a rocker switch. However, alternative switches may be provided, as will be appreciated, for example, a push-button switch. Alternatively or additionally, the switch means may comprise a vibration switch or movement sensor, which activates when the pogo stick is in use, or is otherwise moved.

The leg 65 may be made of steel, footrests 50*a*, 50*b* from aluminum, support member 55 from steel, connection member 75 from steel, biasing means 35 from a suitable metal, and annular lip member 75 from steel. An inner surface of support member 55 may be provided with a bush 36 (not shown), which may be made from PVC. Further, vertically extending tubular members 80*a*, 80*b* may be made from PVC, and the sheath 20 may also be made from PVC, suitably coated or painted to have a metallic appearance. The tubular member 30 may be made from a suitable metal, e.g. steel. Further, the electronic enclosure 60 may be made from a suitable metal. Finally, the foot 70 may be made from rubber or the like, e.g. polypropylene.

Figure 2:
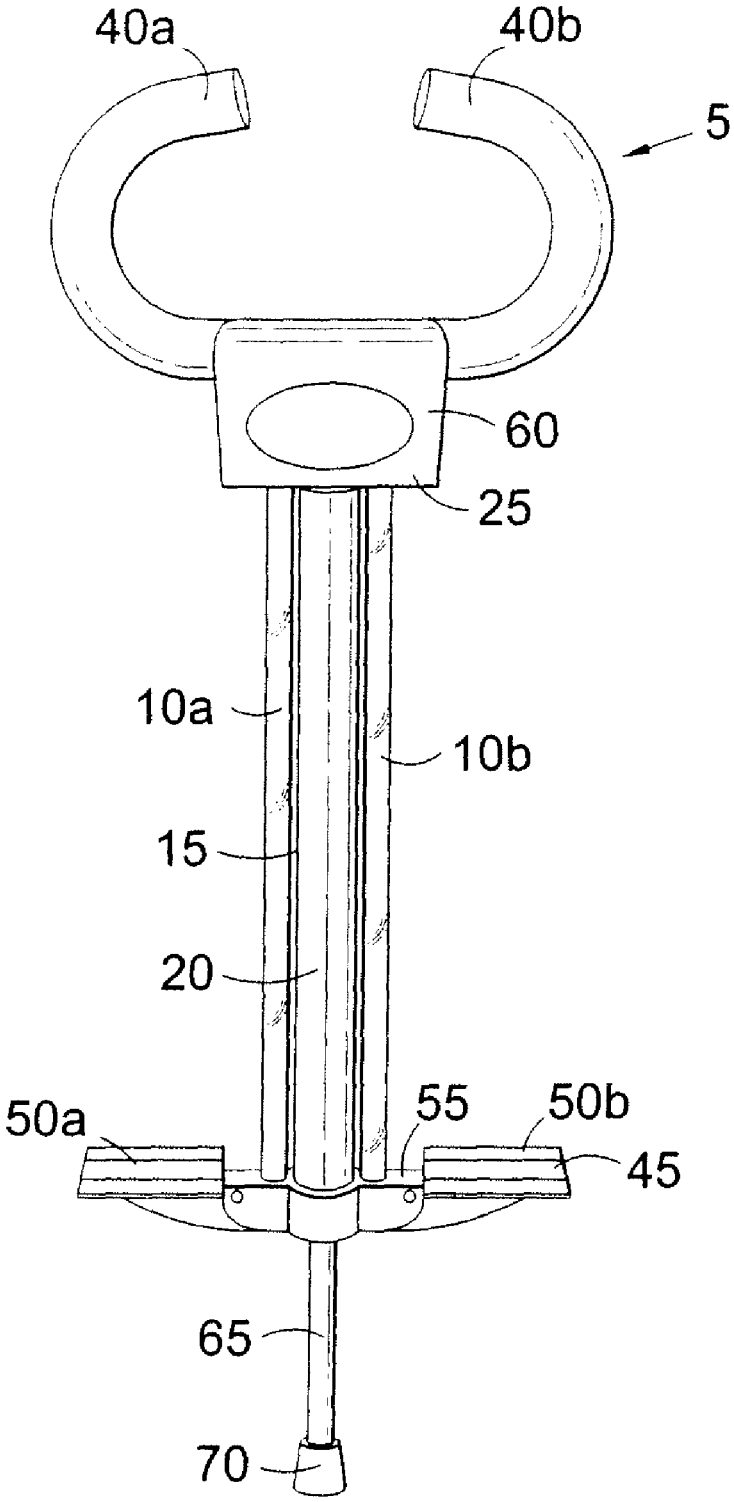
FIG. 2 a front view of the pogo stick of FIG. 1 in an operational configuration.
Figure 3:
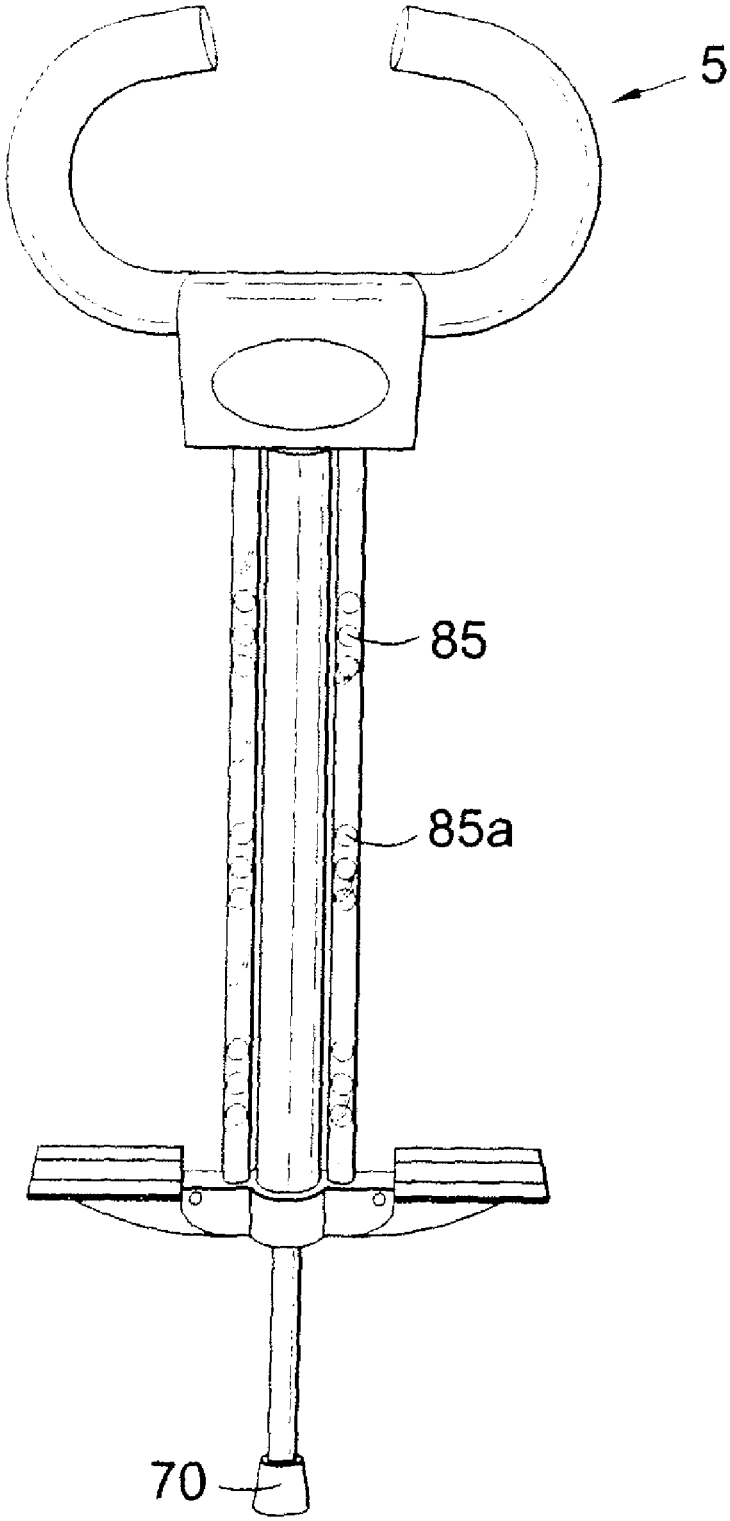
FIG. 3 a front view of the pogo stick of FIG. 1 in an operational configuration and first illuminated state.
Figure 4:
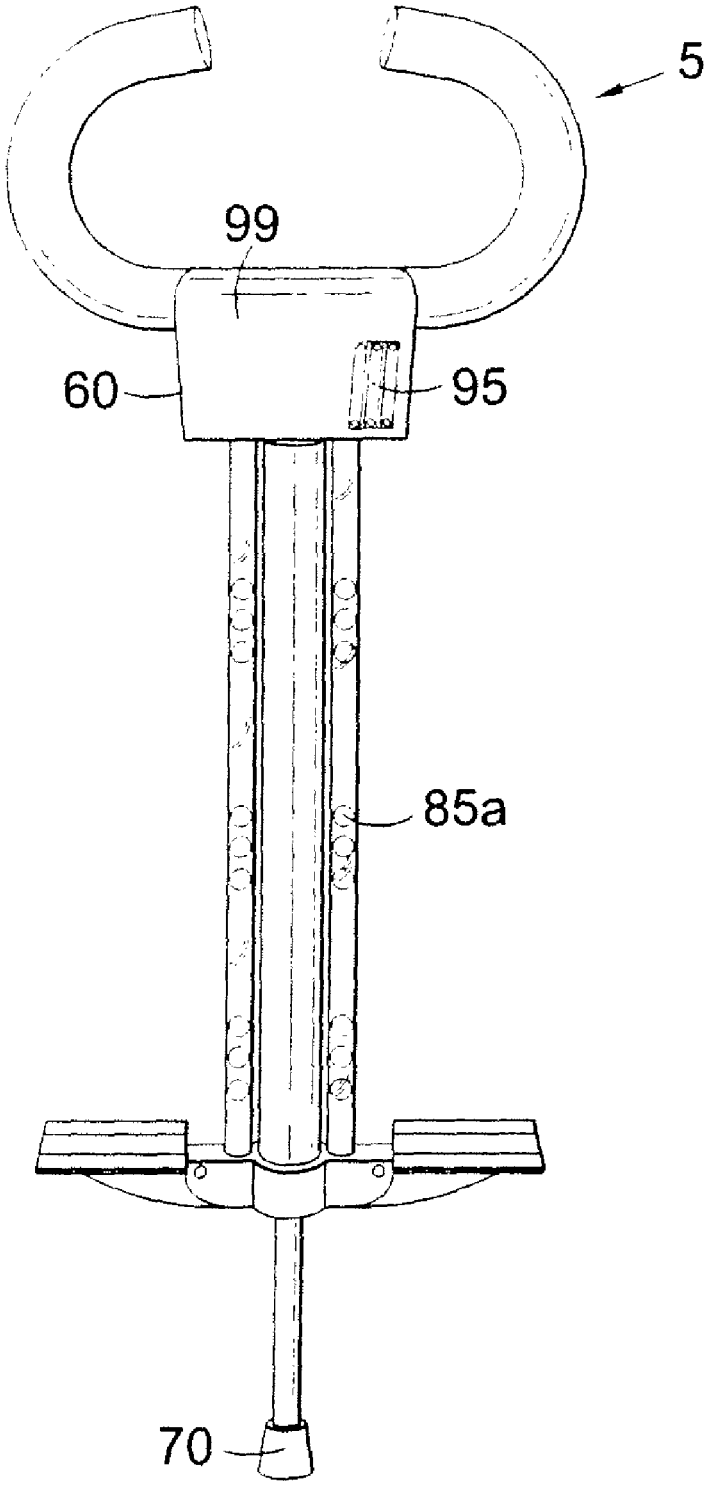
FIG. 4 a rear view of the pogo stick of FIG. 1 in an operational configuration and first illuminated state.
Figure 5:
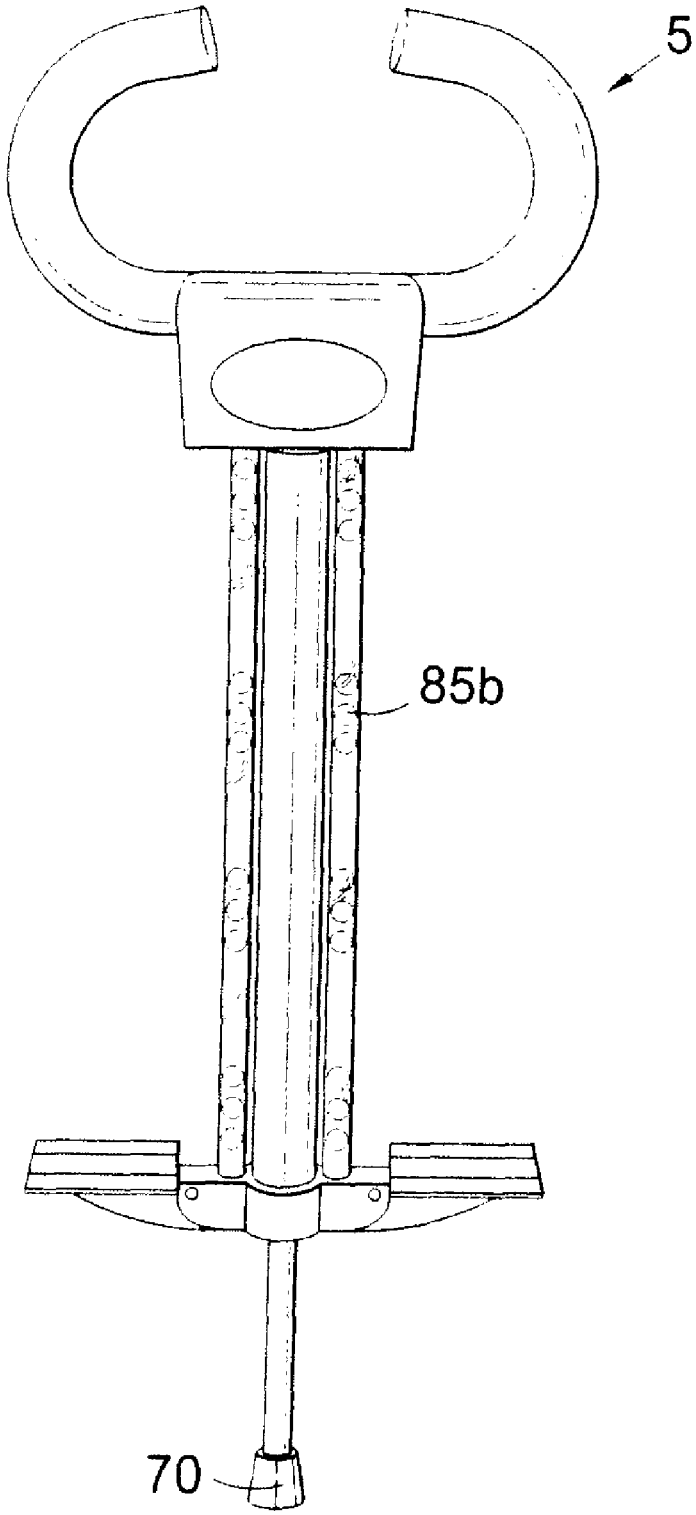
FIG. 5 a front view of the pogo stick of FIG. 1 in an operational configuration and second illuminated state.
Figure 6:
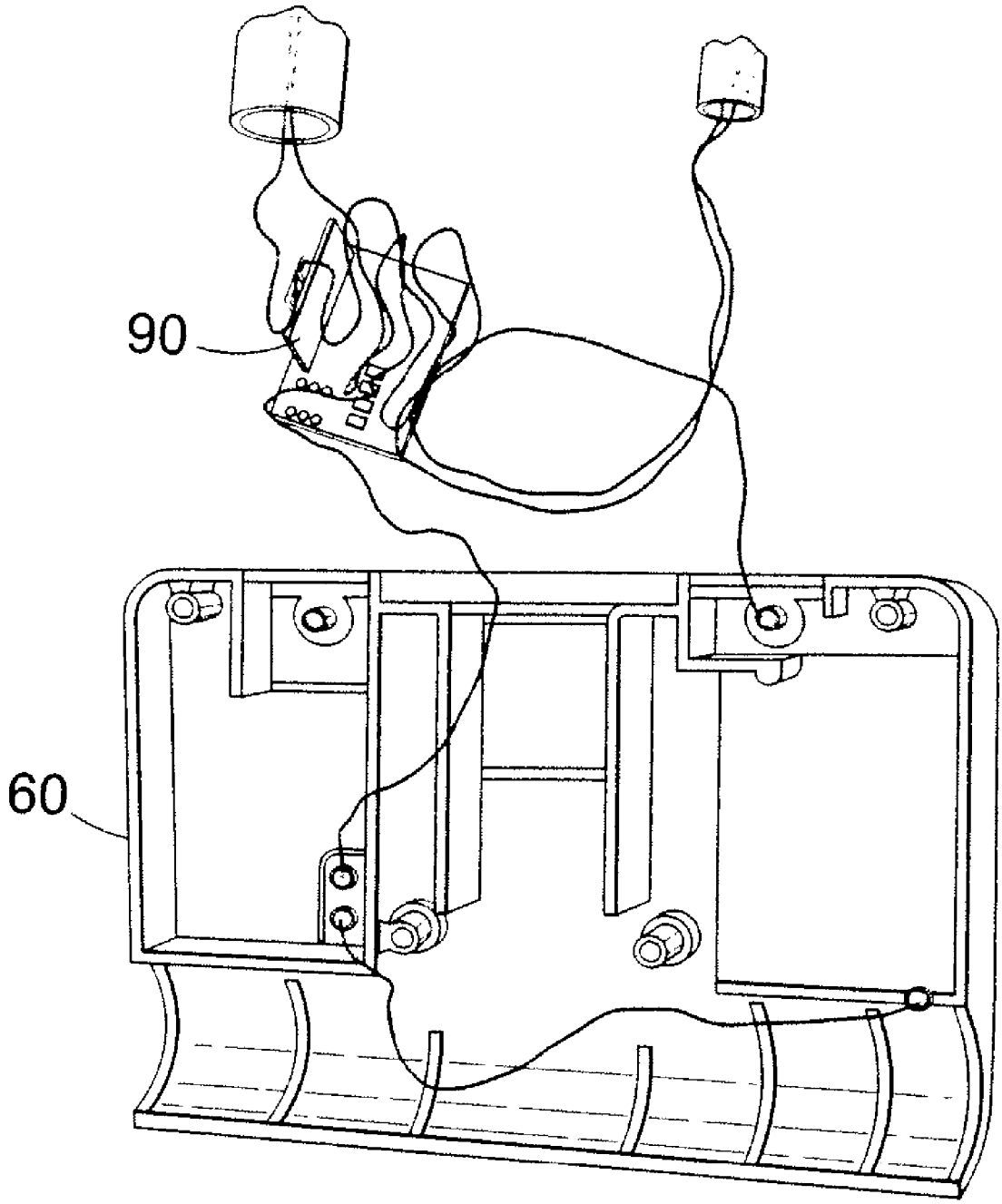
FIG. 6 a front view of electronic circuitry of the pogo stick of FIG. 1.
Figure 7:
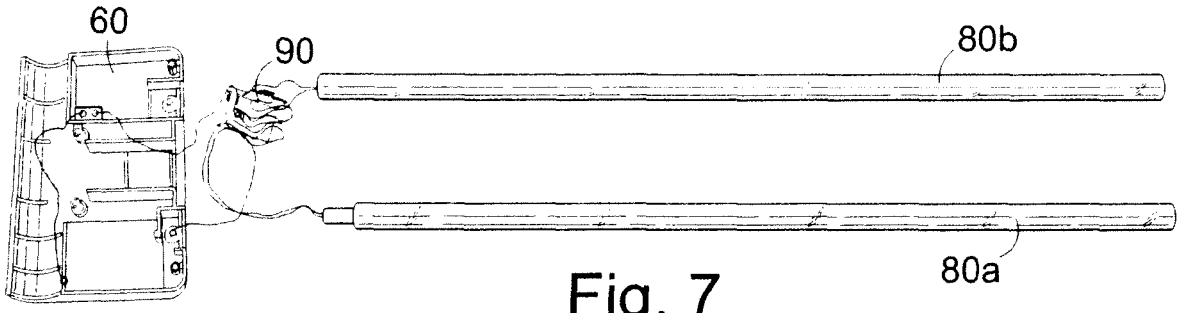
FIG. 7 a front view of electronic circuitry and associated illuminatable means of the pogo stick of FIG. 1 in a non-illuminated condition.
Figure 8:
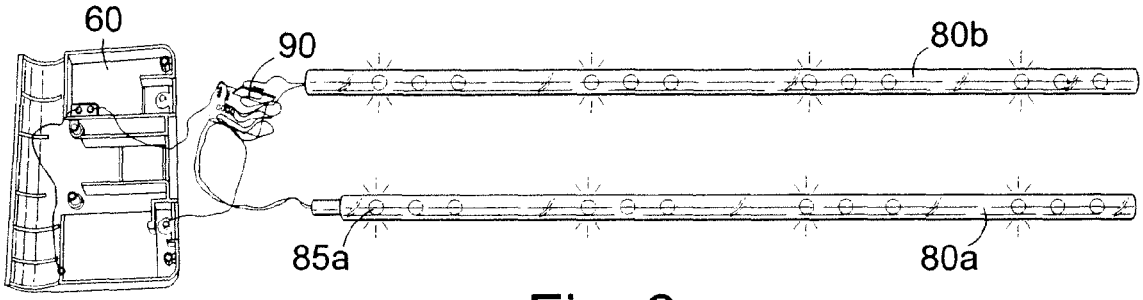
FIG. 8 a side view of the electronic circuitry and associated illuminatable means of FIG. 7 in a first illuminated condition.
Figure 9:
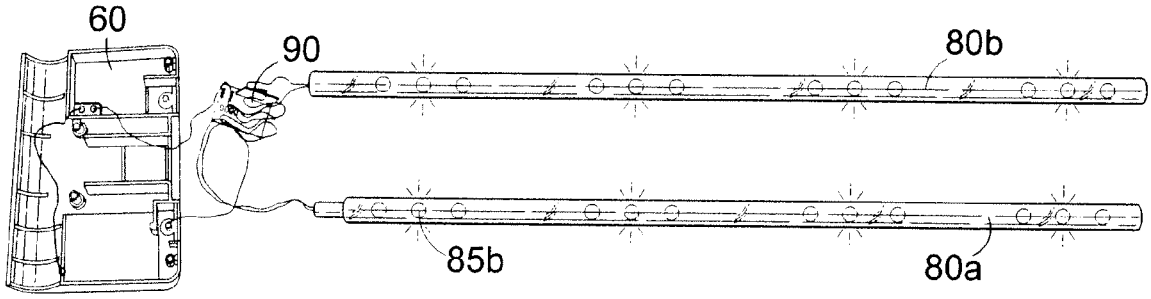
FIG. 9 a side view of electronic circuitry and associated illuminatable means of FIG. 7 in a second illuminated condition.
Figure 10:
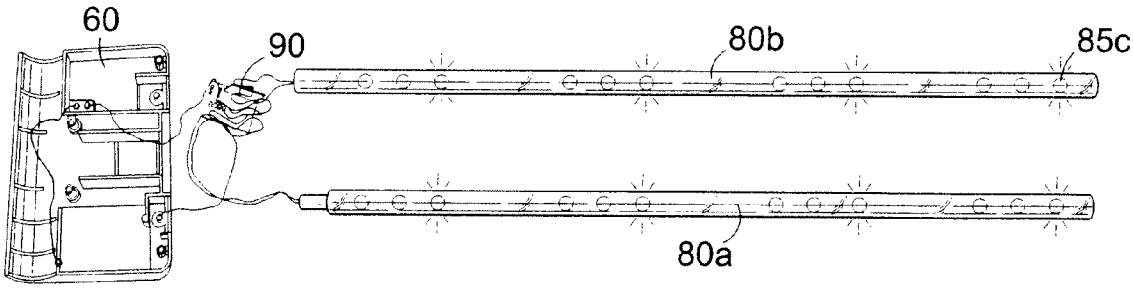
FIG. 10 a side view of the electronic circuitry and associated illuminatable means of FIG. 7 in a third illuminated condition.
Figure 11:
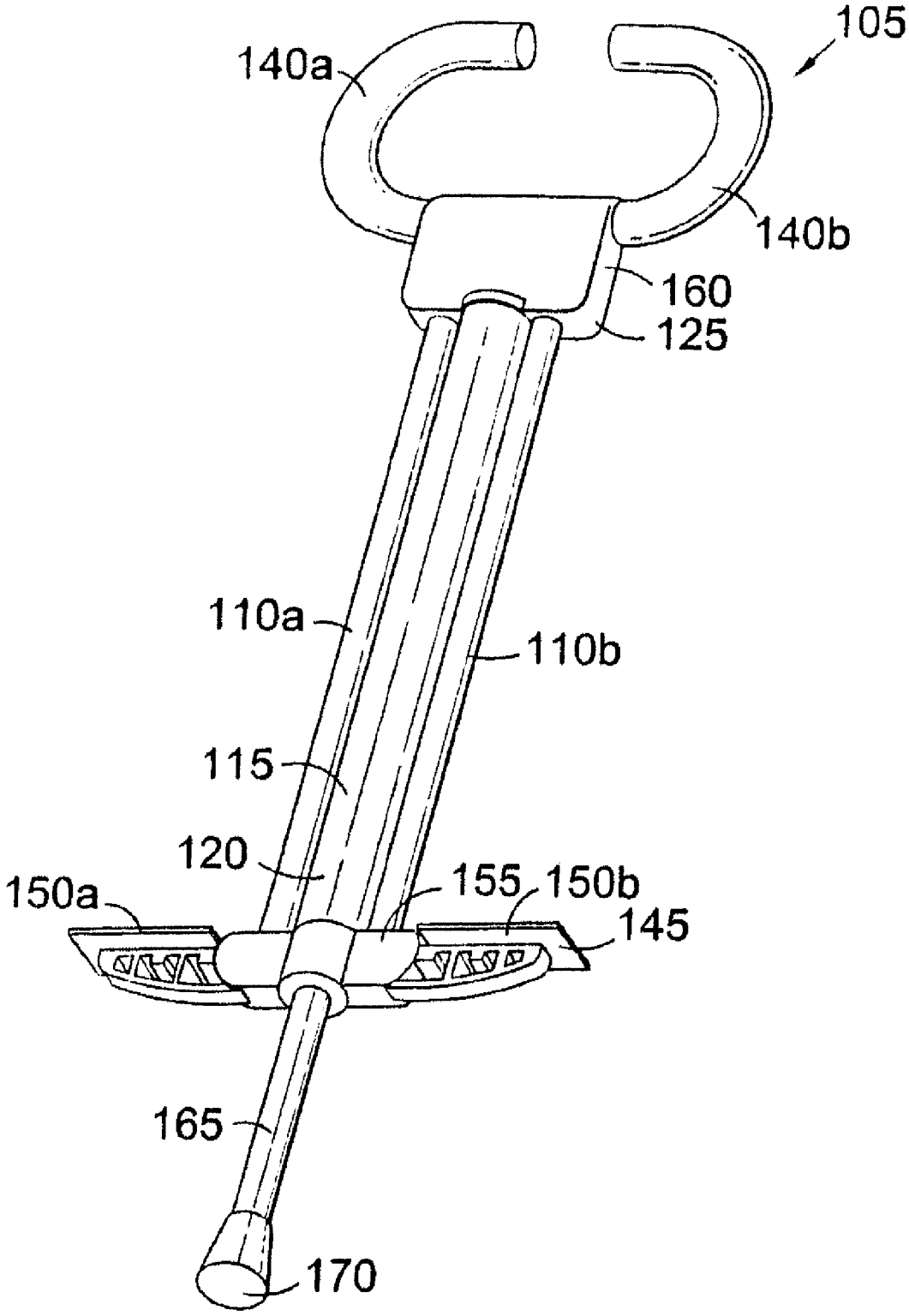
FIG. 11 a perspective view from the front and below of a pogo stick according to a second embodiment of the present invention.
Figure 12:
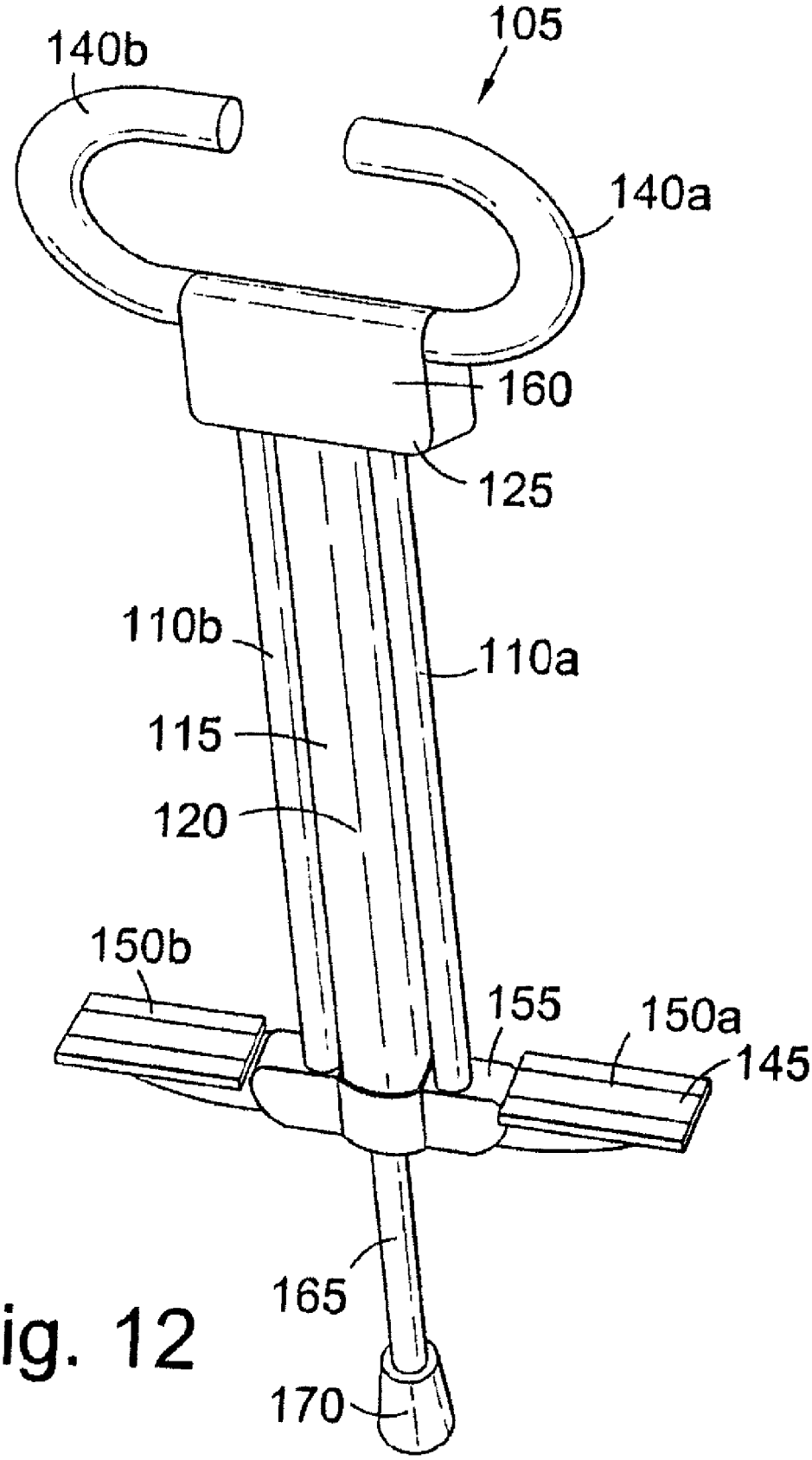
FIG. 12 a perspective view from the rear and above of the pogo stick of FIG. 11.
Figure 13:
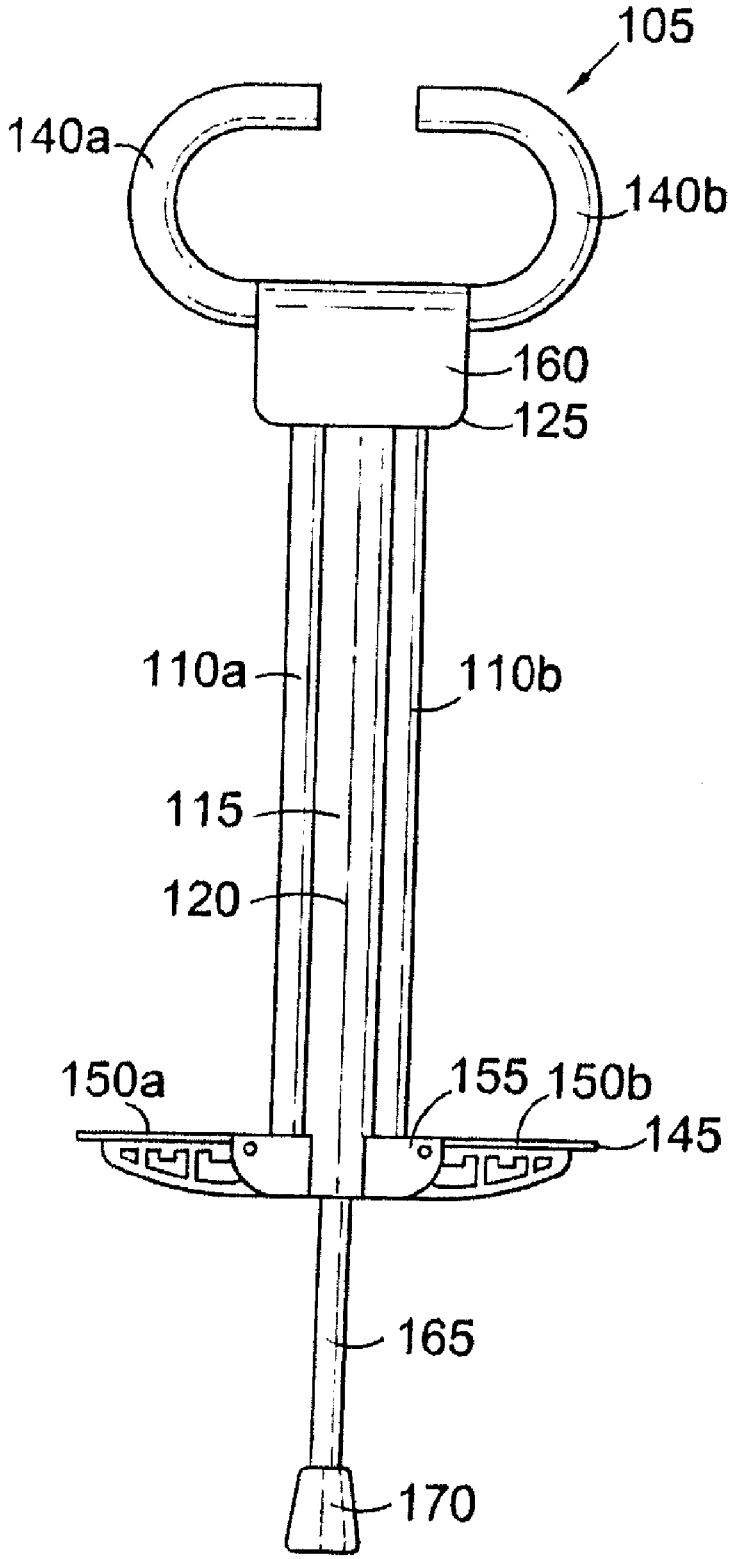
FIG. 13 a front view of the pogo stick of FIG. 11.
Figure 14:
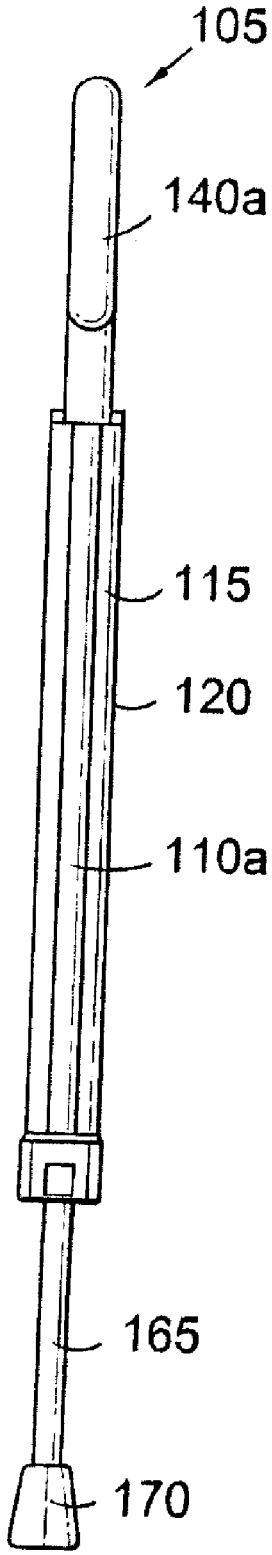
FIG. 14 a side view of the pogo stick of FIG. 11.
Figure 15:
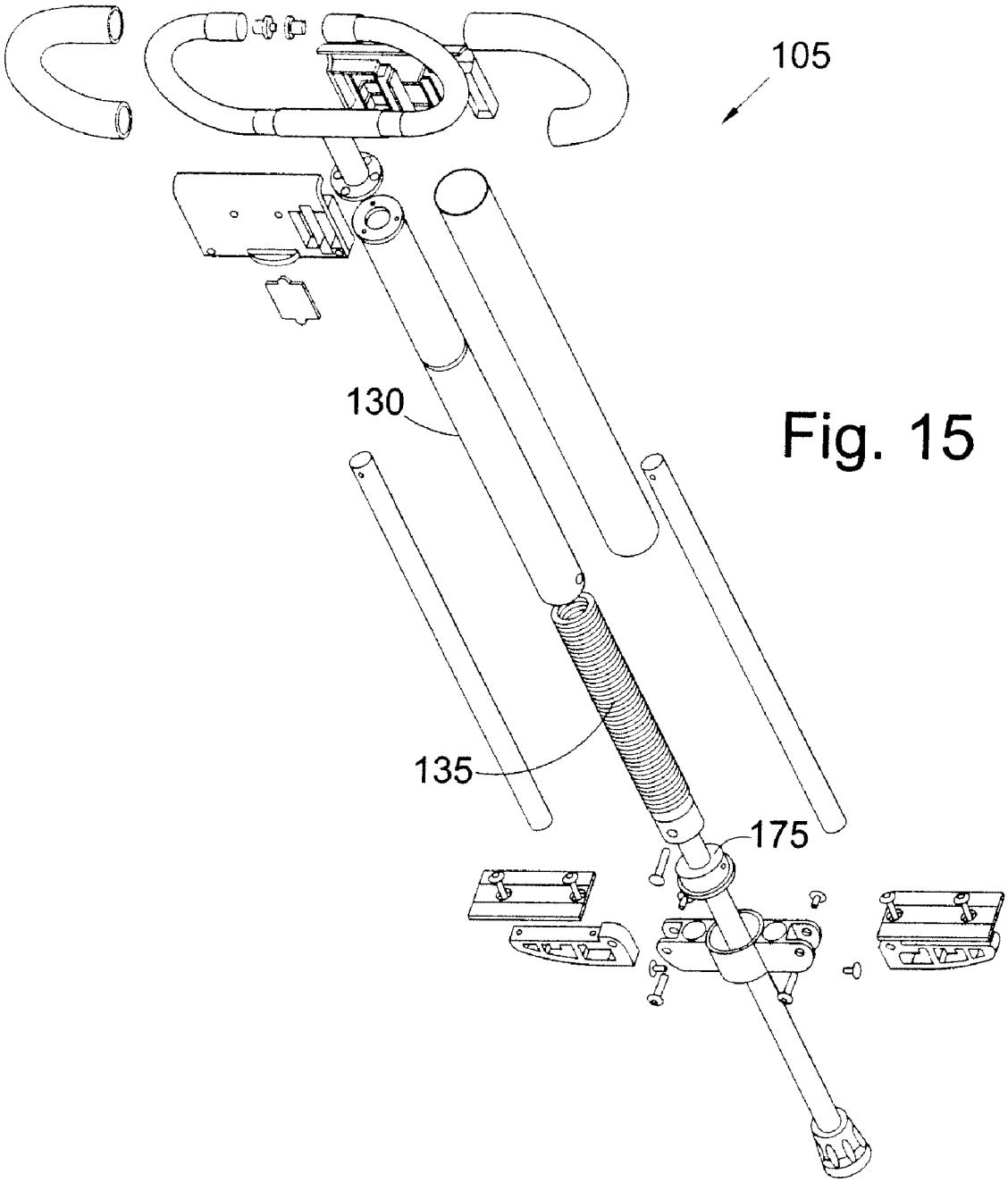
FIG. 15 an exploded perspective view from the front and above of the pogo stick of FIG. 11.

In use, a user may hingeably deploy the footrests 50*a*, 50*b* from a first non-operational configuration as shown in FIG. 1 to a lowered operational configuration shown in FIG. 2. The user may then switch on the illuminatable means by means of switch 95. The user may then stand on the footrests 50*a*, 50*b* and use the pogo stick 5 in a conventional manner. Sequencing of illumination of the LEDs 85, and movement of the pogo stick 5, creates novel lighting effects. These effects can be controlled by the user by virtue of the amount by which the user causes the pogo stick to bounce or jump.

Referring now to FIGS. 11 to 17, there is shown a pogo stick, generally designated 105, according to a second embodiment of the present invention. The pogo stick 105 resembles the pogo stick 5 of FIGS. 1 to 10 in many respects, like parts being designated by like numerals, but increased by "100".

Figure 16:
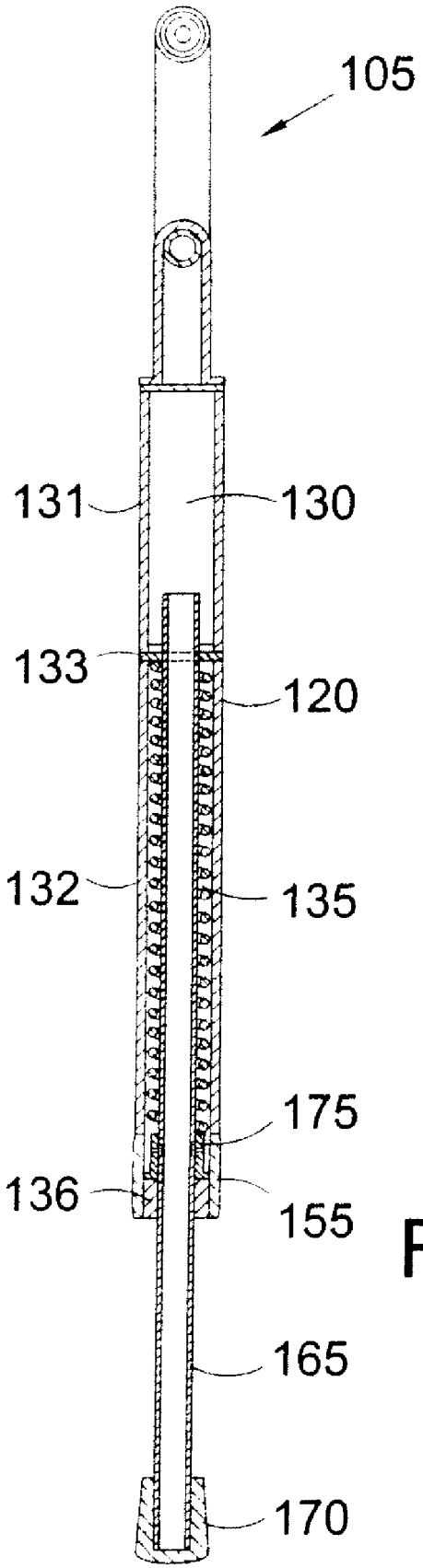
FIG. 16 a cross-sectional side view of the pogo stick of FIG. 11.

The arrangement of the upper end of the leg 165 extending within the tubular member 130 can best be seen from FIG. 16.

The tubular member 130 extends substantially longitudinally, and is positioned substantially coaxially with a central longitudinal axis of the pogo stick 105, and comprises a structural member. The tubular member 130 comprises a first upper tubular portion 131 and a second or lower tubular portion 132, and first and second portion 131, 132 being joined end to end. An annular baffle 133 is provided within the tubular member 130 between adjacent ends of the first and second tubular portions 131, 132. A lower end of the second tubular portion 132 provide a tubular bush 136 for guiding the leg member 165, and for spacing the tubular member 130 and leg member 165 one from the other.

Figure 17:
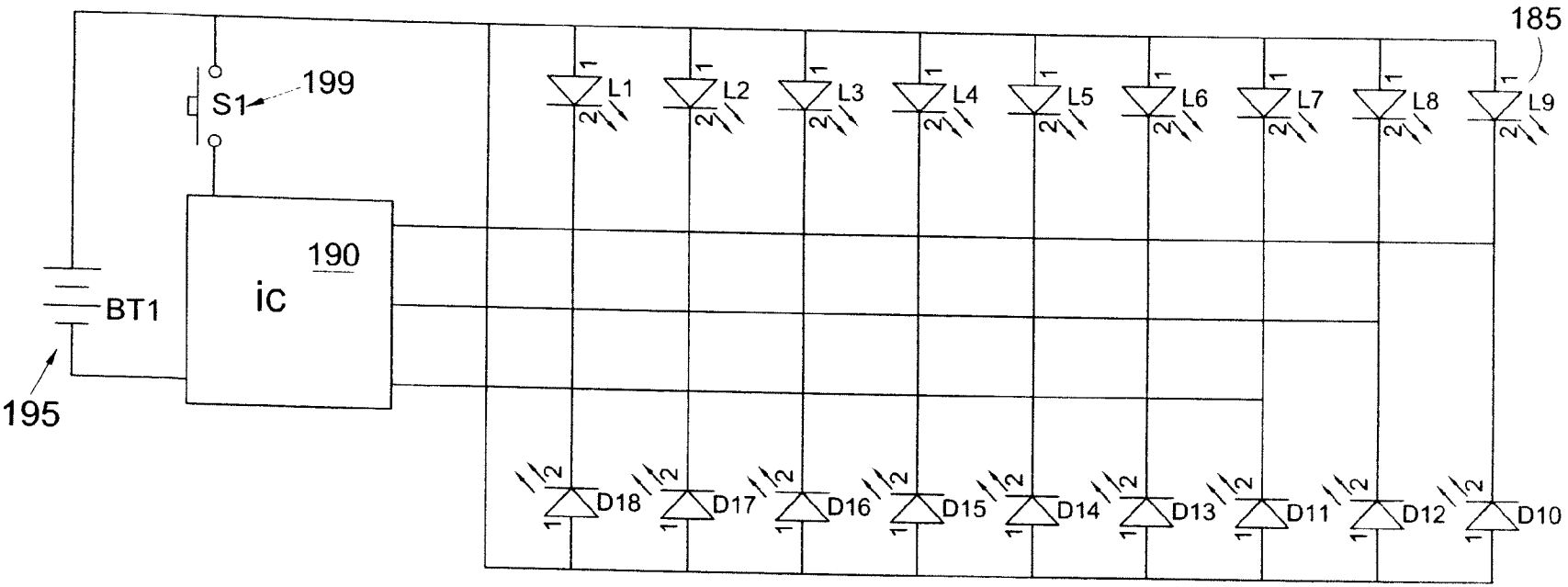
FIG. 17 a schematic view of electronic circuitry of the pogo stick of FIG. 11.

Also shown in FIG. 17 is a detailed schematic circuit diagram of LEDs 185 controlled by switch 195, and IC 196.

Figure 18:
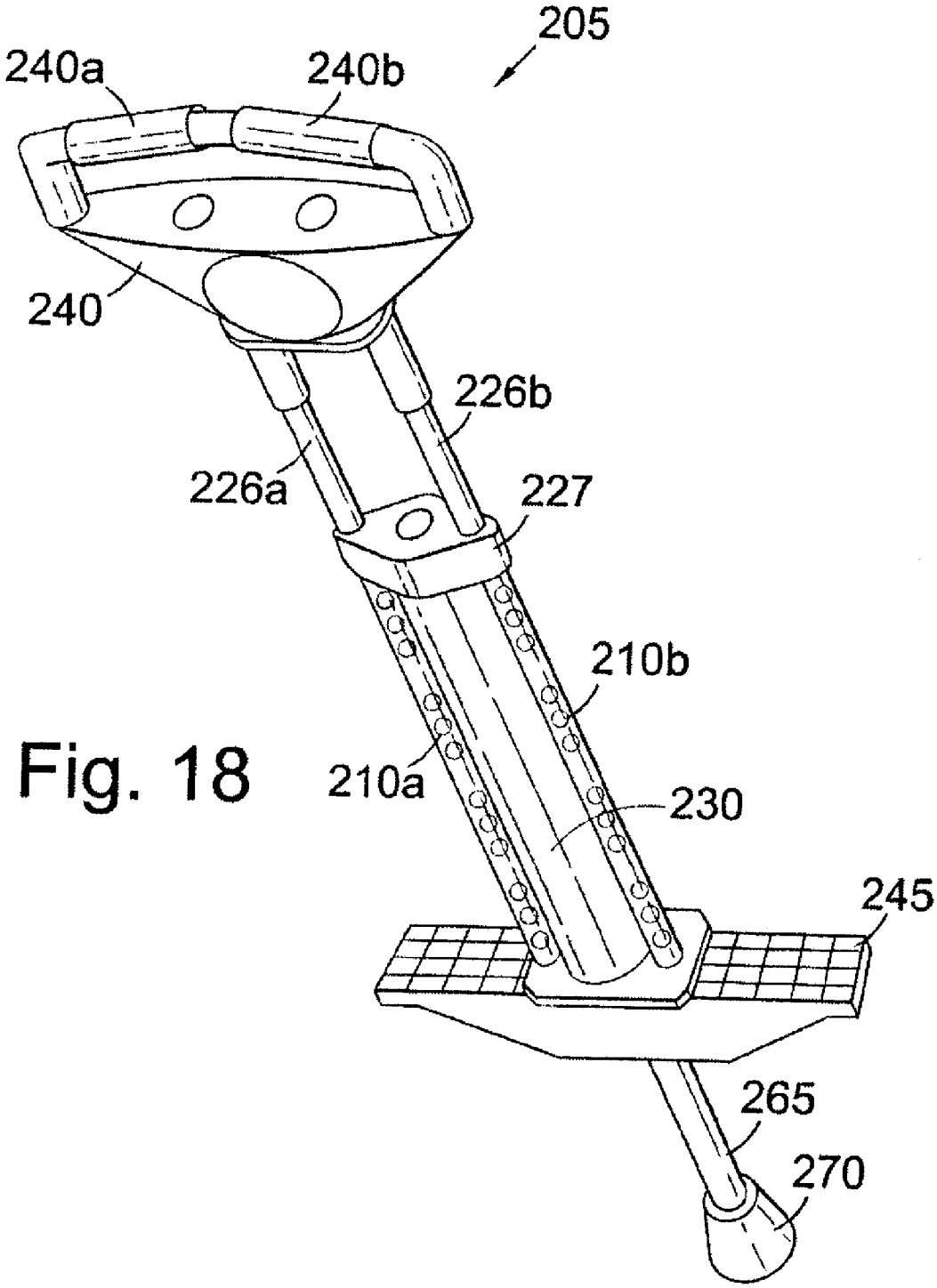
FIG. 18 a perspective view from the front and above of a pogo stick according to a third embodiment of the present invention in an illuminated configuration.

Referring now to FIG. 18, there is shown a third embodiment of a pogo stick 205 according to the present invention. The pogo stick 205 resembles the pogo stick 5 of FIGS. 1 to 10 in many respects, like parts being designated by like numerals, but increased by "200".

The pogo stick 205 does, however, have a different handle arrangement 240, wherein the ends of the handles 240*a*, 240*b* are connected to one another so as to provide a closed shape. Further, frame members 226*a*, 226*b* are provided, which extend to a connection member 227, which connects the frame members 226*a*, 226*b* to a tubular member 230, and illuminatable means 210*a*, 210*b*.

It will be appreciated that the embodiments of the invention hereinbefore described, are given by way of example only, and are not meant limit the scope thereof in any way.

It will be particularly appreciated that the disclosed embodiments provide novel lighting effects over prior art pogo sticks.

Further, it will be appreciated that the disclosed pogo sticks of the present invention provide advantage over the prior art in providing a single vertically extending central structural member.

What is claimed is:

1. A pogo stick comprising a longitudinally extending member having upper and lower portions, a handle which is connected with the upper portion of said longitudinally extending member and is manually engagable by a person using said pogo stick, a platform which is connected with the lower portion of said longitudinally extending member and is engagable by one or more feet of a person using said pogo stick, a leg which is connected with said longitudinally extending member and which extends outwardly from the lower portion of said longitudinally extending member, a spring which is connected with said longitudinally extending member and said leg, said spring being compressible under the influence of force transmitted between said leg and said longitudinally extending member during use of said pogo stick, and a plurality of light sources disposed in a longitudinally extending array which has an upper portion disposed adjacent to and connected with the upper portion of said longitudinally extending member and a lower portion disposed adjacent to and connected with the lower portion of said longitudinally extending member, said plurality of light sources being energizable to provide illumination during use of said pogo stick.

2. A pogo stick as set forth in claim 1 wherein said longitudinally extending array includes at least two light sources of said plurality of light sources in the upper portion of said longitudinally extending array, at least two light sources of said plurality of light sources in the lower portion of said longitudinally extending array, and at least two light sources of said plurality of light sources in an intermediate portion of said longitudinally extending array, said intermediate portion of said longitudinally extending array being disposed between said upper and lower portions of said longitudinally extending array.

3. A pogo stick as set forth in claim 1 further including a tubular member enclosing said longitudinally extending array, said tubular member having an upper portion disposed adjacent to the upper portion of said longitudinally extending member and a lower portion disposed adjacent to the lower portion of said longitudinally extending member.

4. A pogo stick as set forth in claim 3 wherein said tubular member has a linear longitudinal central axis which extends parallel to a linear longitudinal central axis of said longitudinally extending member.

5. A pogo stick comprising a longitudinally extending member having upper and lower portions, a handle which is connected with the upper portion of said longitudinally extending member and is manually engagable by a person using said pogo stick, a platform which is connected with the lower portion of said longitudinally extending member and is engagable by one or more feet of a person using said pogo stick, a leg which is connected with said longitudinally extending member and extends outwardly from the lower portion of said longitudinally extending member, a spring is connected with said longitudinally extending member and said leg, said spring being compressible under the influence of force transmitted between said leg and said longitudinally extending member during use of said pogo stick, a first plurality of light sources disposed in a first longitudinally extending array which has an upper portion disposed adjacent to and connected with the upper portion of said longitudinally extending member and a lower portion disposed adjacent to and connected with the lower portion of said longitudinally extending member, a second plurality of light sources disposed in a second longitudinally extending array which has an upper portion disposed adjacent to an connected with the upper portion of said longitudinally extending member and a lower portion disposed adjacent to and connected with the lower portion of said longitudinally extending member, said longitudinally extending member being disposed between said first and, second longitudinally extending arrays, said first and second pluralities of light sources being energizable to provide illumination during use of said pogo stick.

6. A pogo stick as set forth in claim 5 further including a first tubular member enclosing said first longitudinally extending array, said first tubular member having an upper portion disposed adjacent to the upper portion of said longitudinally extending member and a lower portion disposed adjacent to the lower portion of said longitudinally extending member, and a second tubular member enclosing said second longitudinally extending array, said second tubular member having an upper portion disposed adjacent to the upper portion of said longitudinally extending member and a lower portion disposed adjacent to the lower portion of said longitudinally extending member.

7. A pogo stick as set forth in claim 6 wherein said first and second tubular members have linear longitudinal central axes which extend parallel to a linear longitudinal central axis of said longitudinally extending member.

* * * * *